United States Patent [19]

Liberman

[11] Patent Number: 4,516,626

[45] Date of Patent: May 14, 1985

[54] APPARATUS AND METHOD FOR PRODUCING ARTICLE SHAPES FROM A COMPOSITE MATERIAL

[76] Inventor: Moysey Liberman, 32 Cross Pointe, Greenville, S.C. 29607

[21] Appl. No.: 419,145

[22] Filed: Sep. 17, 1982

[51] Int. Cl.[3] ..... B22D 19/14

[52] U.S. Cl. ..... 164/461; 164/97; 164/99; 164/333; 164/334

[58] Field of Search ..... 164/91, 93, 94, 95, 164/97, 99, 100, 103, 461, 419, 333, 334

[56] References Cited

U.S. PATENT DOCUMENTS

| | | | |
|---|---|---|---|
| 2,301,902 | 11/1942 | Merk | 164/95 X |
| 2,569,150 | 9/1951 | Brennan | 164/103 X |
| 3,367,397 | 2/1968 | Hansson | 164/461 |
| 3,421,569 | 1/1969 | Neumann | 164/461 X |
| 3,938,579 | 2/1976 | Old et al. | 164/100 X |
| 3,941,182 | 3/1976 | Bjorksten et al. | 164/100 X |
| 4,242,368 | 12/1980 | Nagai et al. | 164/461 X |

FOREIGN PATENT DOCUMENTS

| | | | |
|---|---|---|---|
| 29229 | 3/1978 | Japan | 164/99 |
| 438491 | 1/1975 | U.S.S.R. | 164/97 |

*Primary Examiner*—Mark Rosenbaum

*Attorney, Agent, or Firm*—Cort Flint

[57] ABSTRACT

A method and apparatus for producing a shaped composite article from a matrix material and a reinforcing material is disclosed wherein the composite article has predetermined physical and mechanical properties. As illustrated, the apparatus includes a matrix crucible (18) in which a matrix material is contained. A piston (30) is provided for maintaining and controlling the level of the matrix material (19) in the crucible (18) and for controlling the temperature of the matrix material by means of utilizing either a cooling coil (36) or a heating coil (40). A plurality of capillary tubes (26) are carried in a capillary plug (24) through which the reinforcing material is pulled during the process. Shape forming means includes a shape forming plate (42) having an opening (48) formed therein corresponding to the shape of the object being formed. The shape forming plate is spaced above the capillary plug (24) such that a level (44) of matrix material occupies the opening (48) in the forming plate to provide a contact zone above the capillary plug in which the matrix and reinforcing materials contact one another. This level is kept small so that interaction between the two materials is kept at a minimum.

16 Claims, 9 Drawing Figures

APPARATUS AND METHOD FOR PRODUCING ARTICLE SHAPES FROM A COMPOSITE MATERIAL

BACKGROUND OF THE INVENTION

The invention relates to a method and apparatus for making article shapes from composite materials where one of the materials consist of longitudinally extending strands in a matrix with another material which has been solidified from a liquid state.

Heretofore, various methods have been utilized for producing fiber or laminae reinforced metal-metal, ceramic-metal, plastic-ceramic, and other composite articles. Some of the methods more commonly used are the method of directional solidification of eutectic alloys, the liquid phase infiltration method, and the process of passing fibers through a molten bath of a metal matrix and bonding the fiber and matrix adhered thereto in closed dies. However, none of the above methods provide an opportunity to produce fiber or laminae reinforced shapes of complicated configurations with a predetermined distribution of the fibers in the transverse section of the shapes to provide desired reinforcing or structural properties.

The method of directional solidification of eutectics provides a one-step production of composite materials, however, this method is confined to a very limited group of eutectic systems and serves to obtain ingots with strictly determined characteristics of distribution of phases and properties during solidification (see Thomson and Lemkey, "Composite Materials", Vol. 4, Academic Press, New York, 1974). Apparatus for carrying out this method typically includes a mold which is placed in a furnace and heated until the metal becomes molten and is thereafter withdrawn and cooled according to known techniques.

In the method of liquid phase infiltration, the metal is moved by pressure or vacuum into a volume with strands of fibers. The apparatus consists of a mold packed by strands of fibers which form a natural net of capillaries. The mold is connected with a volume of liquid metal which is forced by pressure or vacuum through these capillaries. The method can be used for articles of simple shapes (ingots, rods) and very limited length because of difficulties with creating pressures high enough to move the metal through long capillaries. This method cannot be used for metals and fibers which have an ability of chemical interaction.

Another method of drawing fibers through a molten bath includes the agitation of the interfaces of the fibers and the matrix in the molten bath in the contact zone and cannot be used with material with significant chemical interaction. This method has been utilized mainly to produce rods or sheets with uniformity of properties in their transverse sections. The apparatus for carrying out the method typically includes a molten metal bath through which metal fibers are drawn. The metal is cooled and adheres to the fibers which are pulled therethrough whereafter the solid composite is pulled through a die which shapes the metal matrix around the fibers.

It has also been known to pull a molten metal through a shape plate having a desired shaped opening and thereafter cooling the molten metal to produce a solidified shape. However, this method produces only a plain article of the desired shape and does not provide for the production of composite articles from two or more materials.

Accordingly, an important object of the present invention is to provide a method and apparatus for producing shapes from composite materials in a one-step process in which the distribution of mechanical and physical properties in the composite articles may be predetermined by selectively arranging reinforcing fibers or laminae in the article.

Still another important object of the present invention is to provide a method and apparatus for producing reinforced composite article shapes from two materials in a liquid state.

Still another important object of the present invention is to produce composite article shapes with minimal interfacial reaction in composites by utilizing solid fibers and a liquid matrix material .

Yet another important object of the present invention is to provide a method and apparatus for producing article shapes from composite materials where there is no relative movement between a fiber material and a matrix material in the contact zone by pulling the composite materials together through a shaped plate.

SUMMARY OF THE INVENTION

The above objectives are accomplished according to the present invention by a method wherein either solid fibers or material solidifying into fibers are pulled through a liquid matrix material in a contact zone where there is little or no interaction between the fibers and matrix material due to the level of matrix material through which the fibers are pulled and the simultaneous cooling of the matrix material. From the contact zone, the fibers and the matrix material which has begun to solidify are pulled together through a shaped plate which shapes the matrix of material and fibers as the matrix is cooled and pulled through the shaped plate.

The apparatus includes a furnace with a crucible in which a molten bath of reinforcing material is heated and in which a second crucible is suspended containing a molten bath of a matrix material. A capillary plug is carried in an upstanding pipe in the matrix bath crucible. The capillary plug includes a plurality of capillary openings. A shape plate having a shaped passage formed therein corresponding to the cross-section of a desired article is carried above the capillary plug in a contact zone wherein the reinforcing material and the matrix material contact each other. A starting block with starting wires is inserted through the shaped opening of the plate with the wires extending into the capillary openings of the capillary plug and contacting the molten reinforcing material. As the starting block is pulled out of the plate, the reinforcing material is pulled through the capillary openings. Due to the level of liquid matrix in the contact zone and simultaneous cooling in the contact zone, the liquid reinforcing material begins to solidify with the matrix material as they are pulled through the shape plate from the contact zone by means of the starting block which has been wetted by the matrix. A piston is placed in the matrix material within the crucible to maintain the matrix material at a desired temperature and to maintain the level of the matrix material in the contact zone.

In a second embodiment, a solid fiber is pulled through the capillary openings of the capillary plug to form a composite to produce a shaped article from the solid fibers and the matrix material.

The fibers may be arranged to provide for a desired distribution of mechanical and physical properties in the final composition of the article.

BRIEF DESCRIPTION OF THE DRAWINGS

The construction designed to carry out the invention will be hereinafter described, together with other features thereof.

The invention will be more readily understood from a reading of the following specification and by reference to the accompanying drawings forming a part thereof, wherein an example of the invention is shown and wherein.

DESCRIPTION OF A PREFERRED EMBODIMENT

Figure 1:
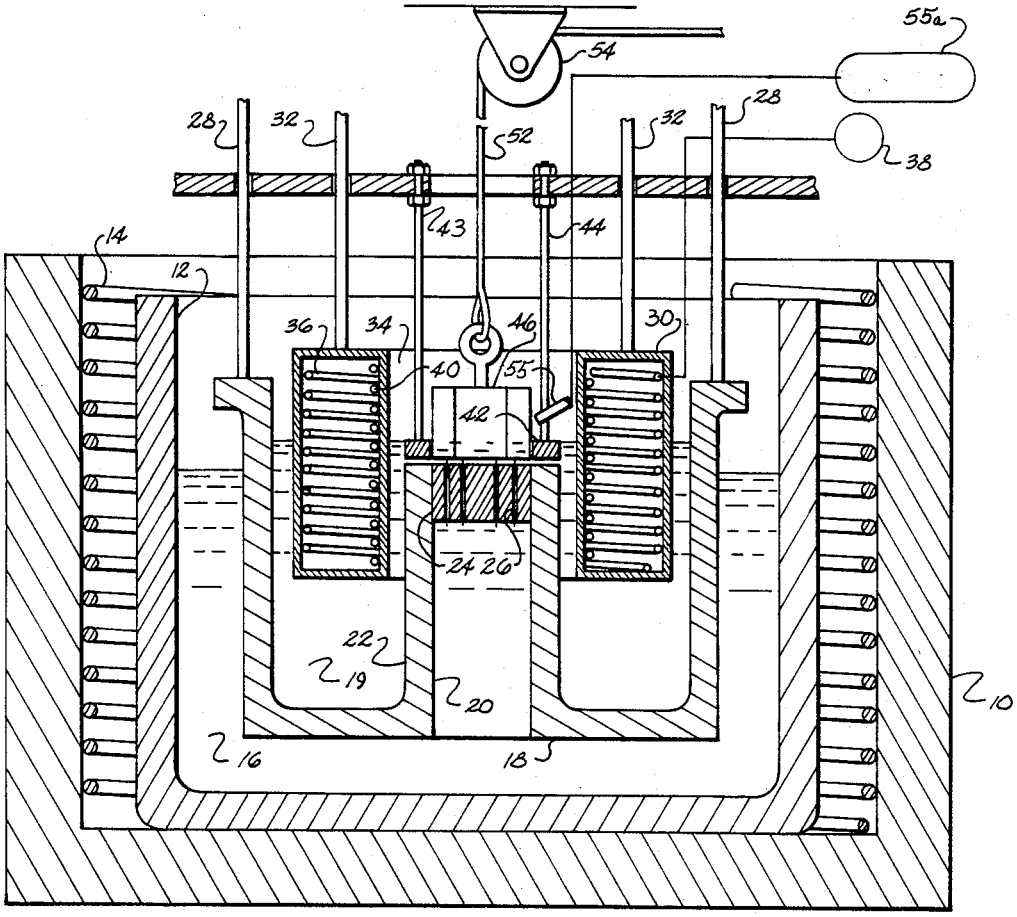
FIG. 1 is a sectional view illustrating apparatus for producing article shapes from composite materials.
Figure 2:
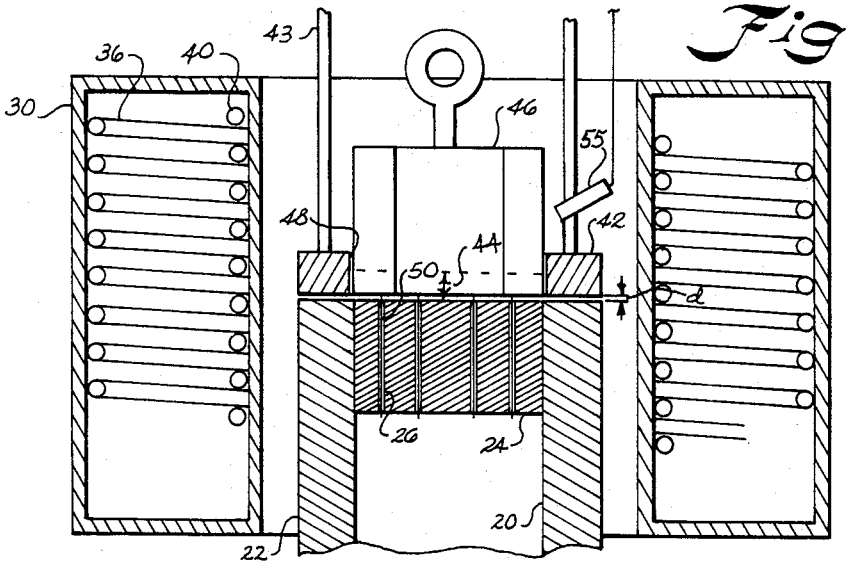
FIG. 2 is an enlarged sectional view illustrating the contact zone of the composite materials and apparatus for pulling the composite shape in more detail according to the invention.

Referring now in more detail to the drawings, FIGS. 1 and 2 illustrate a melting or heating furnace 10 having a crucible 12 which is surrounded by a heating coil 14 which may be any conventional heating coil such as a resistance heating element. A molten reinforcing material 16 is contained in the crucible 12 for producing fibers in a composite article according to the invention. The liquid material 16 is maintained at the desired temperature by means of the heating coil 14. A second crucible 18 for containing a matrix material 19 is carried within the crucible 12 and includes an upright channel 20 defined by interior shortened walls 22 of the crucible. The walls 22 terminate short of the top of the crucible and carry a capillary means in the form of a plug 24. The capillary plug includes a plurality of capillary tubes on openings 26 which communicate with the liquid in the reservoir 16.

By means of locating the capillary tubes in the plug 24 in predetermined locations, distribution and forming of the reinforcing fibers in the composite shaped article may be made according to a predetermined pattern to give to the produced article desired physical and mechanical properties.

The crucible 18 may be raised and lowered in and out of the crucible 12 and material 16 contained therein by any suitable means such as support rods 28 which may be attached to any suitable mechanism for raising and lowering the crucible in and out of the matrix bath.

Means for controlling the level of the matrix material in crucible 18 includes a piston member 30 which is suspended from support rods 32 and may be raised and lowered by a suitable mechanism. The piston 30 includes a central opening 34 which fits over the wall 22 of channel 20 so that the piston may be raised and lowered in the reservoir of the crucible 18. The piston also provides a means of controlling the temperature of the matrix material. The piston 30 has a hollow interior which carries a cooling coil 36. The coil 36 may be connected to a source of cooling fluid 38 which may be any suitable cooling fluid such as liquid sodium.

A heating coil 40 is also carried within the interior of the piston 34 for heating the matrix material as may be required from time to time. The heating coil 40 may be any suitable resistance heating coil. Either the cooling coil or the heating coil may be utilized as is necessary to maintain the temperature of the matrix material 19 at a desired temperature.

A shape forming means includes an article-forming plate 42 carried by means of support posts 43 adjacently above the top of the channel walls 22 and the capillary plug 26. The forming plate 42 is carried a distance, d, above the capillary plug. A level 44 of matrix material is provided to define a contact zone in which the matrix material contained in this space 44 contacts the reinforcing material when the reinforcing material is pulled through the capillary openings. The height of space 44 must be kept small so that there is only a short time for interaction between the matrix and reinforcing material passing through the matrix material contact zone prior to solidification. However, the height of space 44 must be adequate to cause sufficient wetting of the starting shape, described hereafter, so that the matrix material is, due to surface tension forces, pulled with the reinforcing material through the forming plate by means of the starting shape. Levels in the range of 8 mm. have been found adequate for small article shapes.

Means for starting passage of the material through the capillary tubes includes a starting block shape 46 which corresponds to the shape of the opening 48 in the forming plate. A plurality of elongated starting strands 50 is carried by the starting shape 46 which are received in the capillary openings 26 and extending into the reinforcing material 16 a slight distance. The starting shape 46 may be raised and lowered by any suitable means such as by a cable pulley arrangement 52 and 54 and suitable drive therefor (not shown). Strands 50 may be any suitable metal wires with good wetting ability of the liquid metal. In one embodiment, a copper starting piece with steel wires was utilized. The attraction of the metal to the wires causes the pulling of reinforcing metal through the capillaries upon movement of the starting shape and wires.

Figure 3:
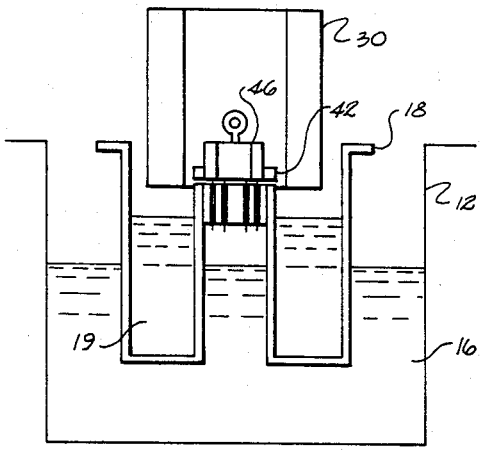
FIG. 3 is a schematic view illustrating the method and apparatus of the present invention for producing article shapes from composite materials with the apparatus illustrated in a starting position.

Referring now to FIGS. 3 thrugh 6, the method according to the present invention will be illustrated for producing article shapes from two molten composite materials.

The solidification temperature of the reinforcing material 16 is higher than that of the matrix material 19. By maintaining the temperature of the matrix material at a desired level, the reinforcing material begins solidification upon contact with the matrix material in the contact zone.

A cooling means is illustrated at 55 which may be an air distribution nozzle connected to a source of compressed air at 55*a*. By this means, the composite of reinforcing and matrix materials is solidified in the contact and shaping zone quickly to assure pulling of the shape in a continuous or semi-continuous process.

FIG. 3 illustrates the apparatus of the invention at the beginning step of the method wherein crucible 18 and piston 30 are in a raised position, the forming plate 42 and starting shape 46 being already lowered to a starting position.

Figure 4:
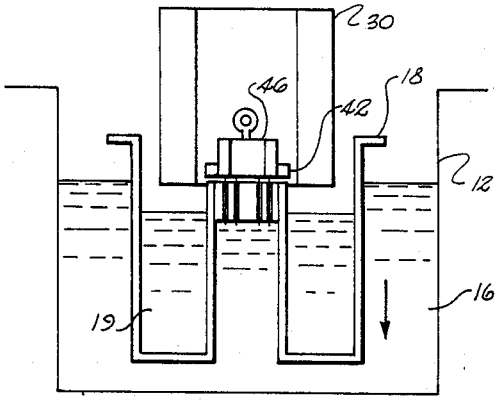
FIG. 4 is a schematic illustration of the method and apparatus of the present invention with the matrix crucible lowered to a starting position.

In FIG. 4, the crucible 18 is lowered to its starting position which causes the level of the fiber material in crucible 12 to be raised just below the upper edge of the top of the capillary plug. At this level, the fiber producing material 16 occupies the capillary tube openings 26 in the capillary plug without overflowing from the top of the plug into the matrix bath.

Figure 5:
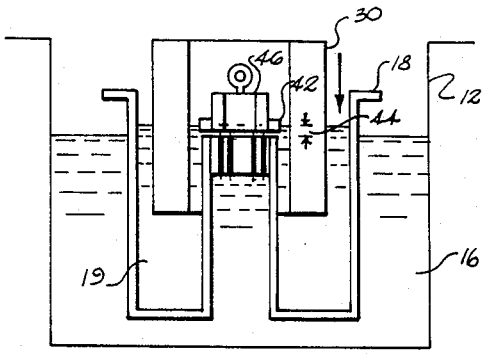
FIG. 5 is a schematic illustration of the method and apparatus according to the present invention with the piston and matrix crucible lowered to a starting position whereby the level of matrix material is raised just beyond the level of the liquid reinforcing material in the furnace crucible.

As illustrated in FIG. 5, the piston 30 is lowered into the crucible 18 such as to cause the level of the matrix material to come just above the lowermost edge of the forming plate 42. The starting shape 46 becomes wetted with matrix material and the reinforcing liquid filling the capillary tubes wets the starting wires. As the starting shape and wires are pulled upwards, the process is started. With the piston 30 so in place, the temperature of the matrix material 19 may be adjusted accordingly. At the same time, the temperature of the fiber producing material may also be adjusted to a desired temperature by means of furnace heater coil 14.

Figure 6:
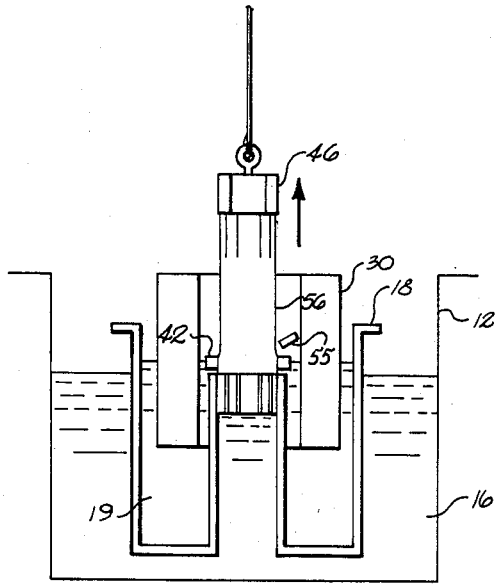
FIG. 6 is a schematic view illustrating a method and apparatus according to the invention with the composite matrix being pulled through the shape plate to form a composite article having a desired shape corresponding to the shaped opening the shape plate.

FIG. 6 illustrates the apparatus and method of the present invention after the material shape has begun to be pulled through the forming plate opening such as to produce the article shape from the composite materials contained in the fiber and matrix crucibles. It will be noted that the forming plate 42 has been located with respect to the top of the capillary plug 24 such that the height 44 of the contact zone is provided so that there is only a limited time of interaction between the fiber forming materials and the matrix material. A longer time of interaction has been found to be adverse to the fiber materials and deterioration of the fibers in the composite article. The interaction time between the materials may be limited by providing a low level of matrix material above the top of the capillary tube and by quickly cooling the materials in the contact zone.

It will be noted that the fiber reinforcing material and the matrix material are pulled and move together through the forming plate from the zone of contact above the capillaries. This is in contrast to general coating methods such as for wires wherein a wire is pulled through a liquid coating material with a part of the material adhered to the wire as a coating. In the present method, either a solid strand or a liquid material which solidifies into a strand as it contacts the matrix material adheres with the matrix material in the contact zone whereby the reinforcing and matrix materials are together pulled through the forming plate whereby the two materials form a composite article of a desired shape.

Figure 8:
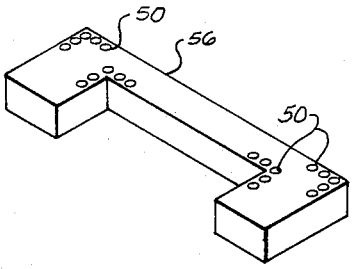
FIG. 8 is a perspective view illustrating a shaped article constructed according to the method and apparatus illustrated in FIG. 7.
Figure 7:
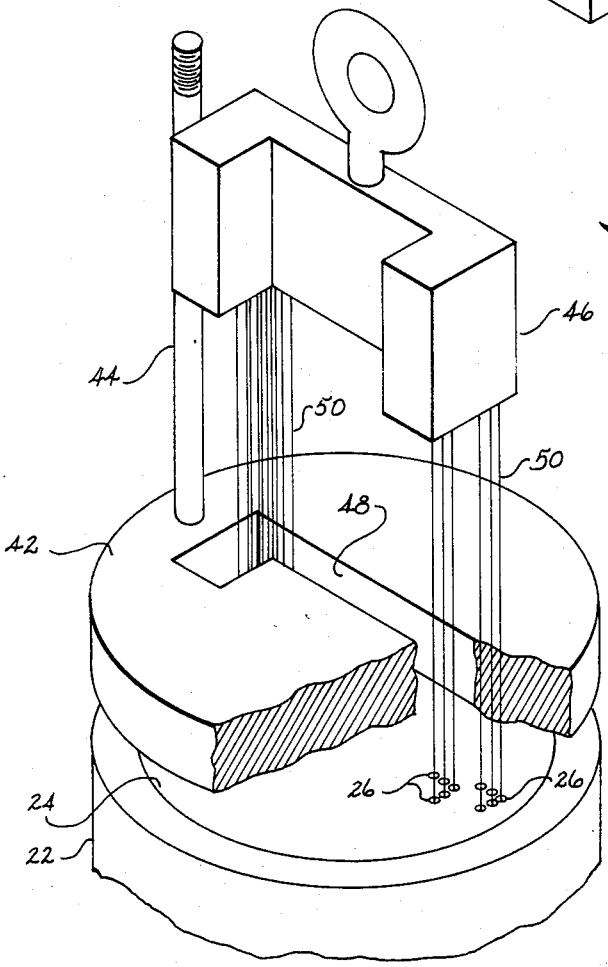
FIG. 7 is a perspective view with parts cut away and separated illustrating a starting block, shape plate, and capillary plug according to the invention.

FIG. 8 illustrates such an article 56 having a shape as pulled through shape forming opening 48. The reinforcing fibers 50 are formed at the corners as shown to provide desired physical and mechanical properties at these locations, the arrangement of the fibers being dictated by the arrangement of capillaries 26 through which the fibers of fiber forming material are drawn.

Figure 9:
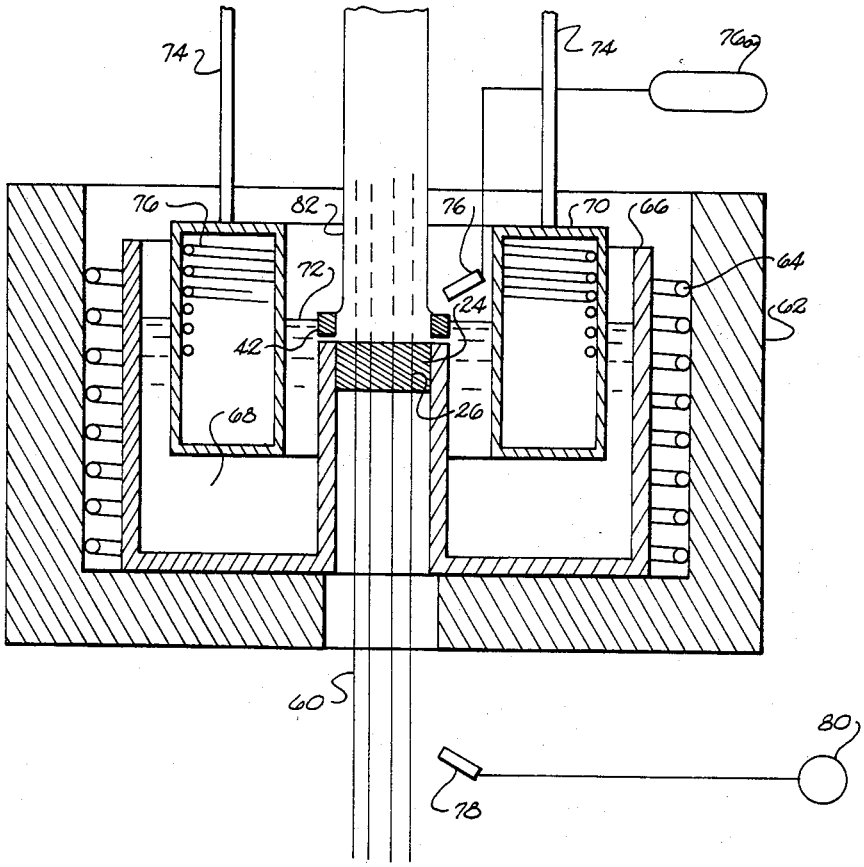
FIG. 9 is a sectional view illustrating a method and apparatus according to the invention wherein solid fibers are pulled through a liquid matrix material to form a composite article according to the invention.

Referring now to FIG. 9, an alternate embodiment of a method and apparatus according to the invention are illustrated wherein solid reinforcing strands 60 are attached to the starting shape in any suitable manner and are withdrawn from a source through the capillary openings 26 in the capillary plug 24. As illustrated, the apparatus includes a crucible furnace 62 having a heating element 64 therein. A crucible 66 is carried within the furnace 62 and contains a matrix material 68. A piston 70 is received in the matrix bath 68 within the crucible 66 to bring the level 72 of the matrix material up to just above the lowermost edge of the forming plate 42. The piston 70 may be raised and lowered by means of any suitable mechanism by means of support rods 74 which suspend the piston. The piston may include a heating coil 76 as is necessary for maintaining the piston at a temperature corresponding to the desired temperature of the matrix material so as not to produce a cooling effect. A means for cooling the article shape as it is pulled through the form plate 42 is produced by means of a nozzle 76 which is connected to a source of a cooling medium such as compressed air at 76*a*. A second nozzle 78 may be utilized for cooling the fibers 60 prior to their entering the matrix bath. Nozzle 78 is connected to a source 80 of coolant such as compressed air. In this manner, a higher rate of production may be achieved for pulling the article 82 through the forming plate.

According to the method, the solidification temperature of the material for the fibers should be 5–50 degrees centigrade higher than the solidification temperature for the matrix material so that the fiber material will begin to solidify upon contact with the matrix material in the contact zone. It is also desirable that the material for the fibers have a narrow interval of solidification temperatures so that the material solidifies quickly. For these purposes, the fiber material should be chosen as a pure component, a eutectic, or a chemical compound. It is also preferred that the levels of the various materials in the curcibles be kept fairly constant during the process with fluctuations in the levels of materials not being more than plus or minus 5 millimeters. The level of the liquid matrix material 16, 68 should be maintained just above the upper edge of the capillary plug and be in the range of from 5–30 millimeters as illustrated at 44 and 72, respectively.

For purposes of illustration, the following examples are offered to facilitate an understanding of the invention:

EXAMPLE 1

A Z-shape with 3 mm. wall thickness and reinforced shelves was produced from two molten metals. The reinforcing material is a molten metal contained in the outer crucible consisting of aluminum with 50 weight percent of copper. The solidification temperature of the metal is approximately 590 degrees centigrade. The temperature of the metal in the crucible was maintained at 600 plus or minus 5 degrees centigrade. The inner crucible was lowered into the starting position with the installed forming plate containing a Z-shaped slot. The starting shape with attached starting wires 0.2 mm. made from steel was placed into the forming plate slot with the wires located in capillaries of the plug. The molten matrix material is prepared in a separate furnace and was poured into inner crucible to the level of 30–50 mm. below the edge of the capillary plug. The matrix metal consists of aluminum with 12 weight percent of silicon. The temperature of solidification is approximately 577 degrees centigrade. The piston 30 is lowered into the matrix metal to raise the level of metal approximately 20–30 mm. below the edge of the plug and by means of heating or cooling of the piston, the temperature in crucible was set at 585 plus or minus 5 degrees centigrade. Then, the piston was moved down again to bring the level of the matrix metal up to the desired level approximately 10 mm. above the edge of the capillary plug. After 10–15 seconds, the cooling system for shape was turned on with simultaneous lifting of the starting block consisting of the starting shape and wires causing the flow of the composite material through the forming shape. The shape was cooled by flow of compressed air. The speed of pulling was approximately 100 mm. per min. during continuous processing.

EXAMPLE 2

The method was used for obtaining the same shape as in Example 1 from a matrix material of molten aluminum with 1.5 weight percent of manganese reinforced by 0.1 mm. diameter graphite fibers.

The temperature of solidification was approximately 655 degrees centigrade. The temperature of the matrix metal was maintained in the crucible 690 plus or minus 5 degrees centigrade. The starting plate was placed above the plug with capillaries. Initially, the level of molten matrix metal was 50 mm. below the edge of the plug. The graphite fibers were pulled through the capillaries and fastened to the starting shape by any suitable means. The starting shape was placed into the slot of the starting plate. The piston was then moved down into the crucible to raise the metal level to the upper level of the starting plate but not higher than 10 mm. above the edge of the plug to bring to the minimum the possibility of chemical interaction of molten metal and graphite fibers. After 10–15 seconds, the cooling systems for the fibers and shape were turned on with simultaneous lifting of the starting shape with fibers attached. The cooling was conducted by compressed air. The speed of pulling the shape was about 500 mm./min.

While a preferred embodiment of the invention has been described using specific terms, such description is for illustrative purposes only, and it is to be understood that changes and variations may be made without departing from the spirit or scope of the following claims.

What is claimed is:

1. Apparatus for producing shaped composite articles from a matrix material and a reinforcing material to reduce the interaction of the materials in producing said articles, said apparatus comprising:

a matrix crucible for containing said matrix material;

furnace means for heating said matrix material to a desired temperature;

capillary means carried by said matrix crucible having an interior side exposed to fluid communication with said matrix material and an exterior side out of contact with said matrix materials; said capillary means including a number of capillary openings for the passage of said reinforcing material;

shape forming means carried adjacent said capillary means:

means for providing a liquid contact zone in which said reinforcing material first contacts said matrix material to form a composite material, said liquid contact zone being defined by a predetermined level of said matrix material between said capillary means and said shape forming means;

liquid level control means for controlling and maintaining said predetermined level of said matrix material in said matrix crucible above the level of said capillary means so that little or no chemical interaction between said reinforcing material and matrix material takes place during the time and space of said contact zone;

means for passing said reinforcing material serially through said capillary openings of said capillary means and said contact zone to form said composite material;

said capillary means preventing physical contact of said matrix material and reinforcing material except above said capillary means in said liquid contact zone;

means for passing said composite material through said shape forming means;

said shape forming means forming said composite material into a desired shape corresponding to said shape forming means; and means solidifying said composite material passing through said shape forming means producing a solid composite article of a predetermined shape and having predetermined physical and mechanical properties.

2. The apparatus of claim 1 wherein said means for solidifying said composite material includes cooling means arranged adjacent said shape forming means enhancing the solidification of said composite material passing therethrough.

3. The apparatus of claim 1 including:

a second crucible container for containing a liquid reinforcing material;

said matrix crucible adapted for being carried within said second crucible;

upright conduit means carried within an interior of said matrix crucible; and said capillary means being carried by said conduit means in fluid communication with said matrix crucible.

4. The apparatus of claim 3 wherein said means for passing said reinforcing material through said capillary means and said means for passing said composite material through said forming means include starting means having a shape corresponding generally to the shape of said shape forming means, a plurality of starting strands carried by said starting means, means moving said starting means into a starting position wherein said starting means is moved into said shape forming means in contact with said matrix material unit, said starting strands extending into said capillary means whereby movement of said starting means away from said shape forming means causes said liquid reinforcing material to be drawn through said capillary means into said contact zone and thereafter pass together with said matrix material through said shape forming means for solidification therewith and production of said shaped composite article.

5. The apparatus of claim 1 wherein said means for passing said composite material through said shape forming means includes starting means which includes a starting block having a shape corresponding generally to the shape of said forming means, means moving said starting block through said forming means into contact with said matrix material whereupon said material is pulled through said forming means upon reverse movement of said starting block.

6. The apparatus of claim 5 wherein said reinforcing material includes solid strands extending through said capillary means attached to said starting means.

7. The apparatus of claim 1 wherein said means for starting the passage of said reinforcing material and said composite material includes starting means having a starting shape corresponding to that of said shape forming means, said reinforcing material including elongated strands of reinforcing material carried by said starting means, extending through said capillary means and contacting said matrix material; means for moving said starting means into a starting position and thereafter move said starting means away from said shape forming means starting the passage of said composite material through said forming means.

8. The apparatus of claim 1 wherein said capillary means includes a plug carried by an upstanding conduit having a plurality of capillary tubes formed therein, said capillary tubes being arranged in said plug to distribute said fiber producing material passing therethrough in said composite articles to provide predetermined physical and mechanical properties thereto.

9. The apparatus of claim 1 wherein said capillary means includes means distributing said reinforcing material at predetermined locations in said composite material and said composite article to provide desired physical and mechanical properties therefor.

10. Apparatus for producing shaped composite articles from a matrix material and a reinforcing material comprising:

a first container for containing a liquid matrix material;

means for heating said matrix material;

a second container containing a liquid reinforcing material;

means suspending said first container within said second container;

means for passing said reinforcing material into said second container through said matrix material to form a composite material therewith;

shape forming means for forming said composite material into a desired shape corresponding to the article being produced;

means pulling said composite material through said forming means;

means solidifying said shaped composite material being pulled through said shape forming means; and means distributing said reinforcing material in said composite article in desired locations to provide predetermined physical and mechanical properties to said article.

11. A method of producing a shaped composite article from a matrix material and a reinforcing material to reduce the interaction between the material and whereby the composite article has predetermined physical and mechanical properties comprising:

providing a first matrix material;

providing a second reinforcing material;

heating said matrix material to maintain said material in a fluid state;

providing a capillary means disposed between said first and second materials in fluid communication with said first material including a number of capillary openings separating said first and second materials from fluid communication with one another, said capillary openings preventing passage of said first material through said capillary means while allowing passage of said second material to prevent physical contact with one another except above said capillary means in said liquid contact zone;

providing a shape forming means adjacent and in alignment with said capillary means;

providing a contact zone consisting of a predetermined level of said first material between said capillary means and shape forming means in which said second material is first brought into contact with said first material;

controlling the level of said first material so that the predetermined level of said first material in said contact zone is above said capillary means and in contact with a lowermost surface of said shape forming means;

maintaining said first and second materials out of physical contact except in said liquid contact zone;

passing said second material through said capillary openings of said capillary means and through said contact zone to form a composite material with said first material in said contact zone;

arranging said second material in said composite material to provide desired physical and mechanical properties to said article; and passing said composite material through said shape forming means and solidifying said composite material to form a shaped composite article.

12. The method of claim 11 wherein said second material is a liquid reinforcing material.

13. The method of claim 12 wherein said second material has a higher temperature of solidification than said first material.

14. The method of claim 13 including cooling said composite material as it passes through said shape forming means.

15. The method of claim 12 including heating said first material to a temperature below the solidification temperature of said second material and above the solidification temperature of said first material.

16. The method of claim 11 wherein said second material includes solid fiber strands.

* * * * *